United States Patent [19]

Melzer

[11] 4,006,684

[45] Feb. 8, 1977

[54] PRINTING MACHINE

[75] Inventor: Roland Melzer, Schwelm, Germany

[73] Assignee: R. Melzer oHG Machinenbau u. Metallverarbeitung, Schwelm, Germany

[22] Filed: Nov. 18, 1975

[21] Appl. No.: 633,156

[30] Foreign Application Priority Data

Nov. 22, 1974 Germany ..... 2455382

[52] U.S. Cl. ..... 101/212

[51] Int. Cl.[2] ..... B41F 5/04

[58] Field of Search ..... 101/212, 250, 252, 253, 101/256, 260, 261, 269, 270, 272, 277, 282, 288, 291, 353, 356, 357

[56] References Cited

UNITED STATES PATENTS

| | | | |
|---|---|---|---|
| 353,312 | 11/1886 | Kelly | 101/289 |
| 796,707 | 8/1905 | Clark | 101/212 |
| 857,721 | 6/1907 | Clark | 101/212 |
| 887,820 | 5/1908 | Kuster | 101/212 X |
| 1,051,213 | 1/1913 | Gammeter | 101/212 |
| 2,017,010 | 10/1935 | Meisel et al. | 101/212 |
| 3,101,666 | 8/1963 | Sawtelle | 101/212 |
| 3,164,088 | 1/1965 | Vechot | 101/212 |

*Primary Examiner*—J. Reed Fisher
*Attorney, Agent, or Firm*—Watson, Cole, Grindle & Watson

[57] ABSTRACT

A printing machine is provided for printing a discontinuously moved, flat web in which the mass of the components which must be moved in a reciprocating manner is reduced significantly. A shaft which is affixed to the printing block carrier is movably guided in a fixed frame between a pair of extreme positions of linear movement during the printing process. A stationary inking device is disposed at one extreme position and there contacts the printing block. Cam surfaces on the frame and printing block carrier guide the carrier through superimposed rotational and reciprocating linear movements.

12 Claims, 5 Drawing Figures.

PRINTING MACHINE

Figure 1:
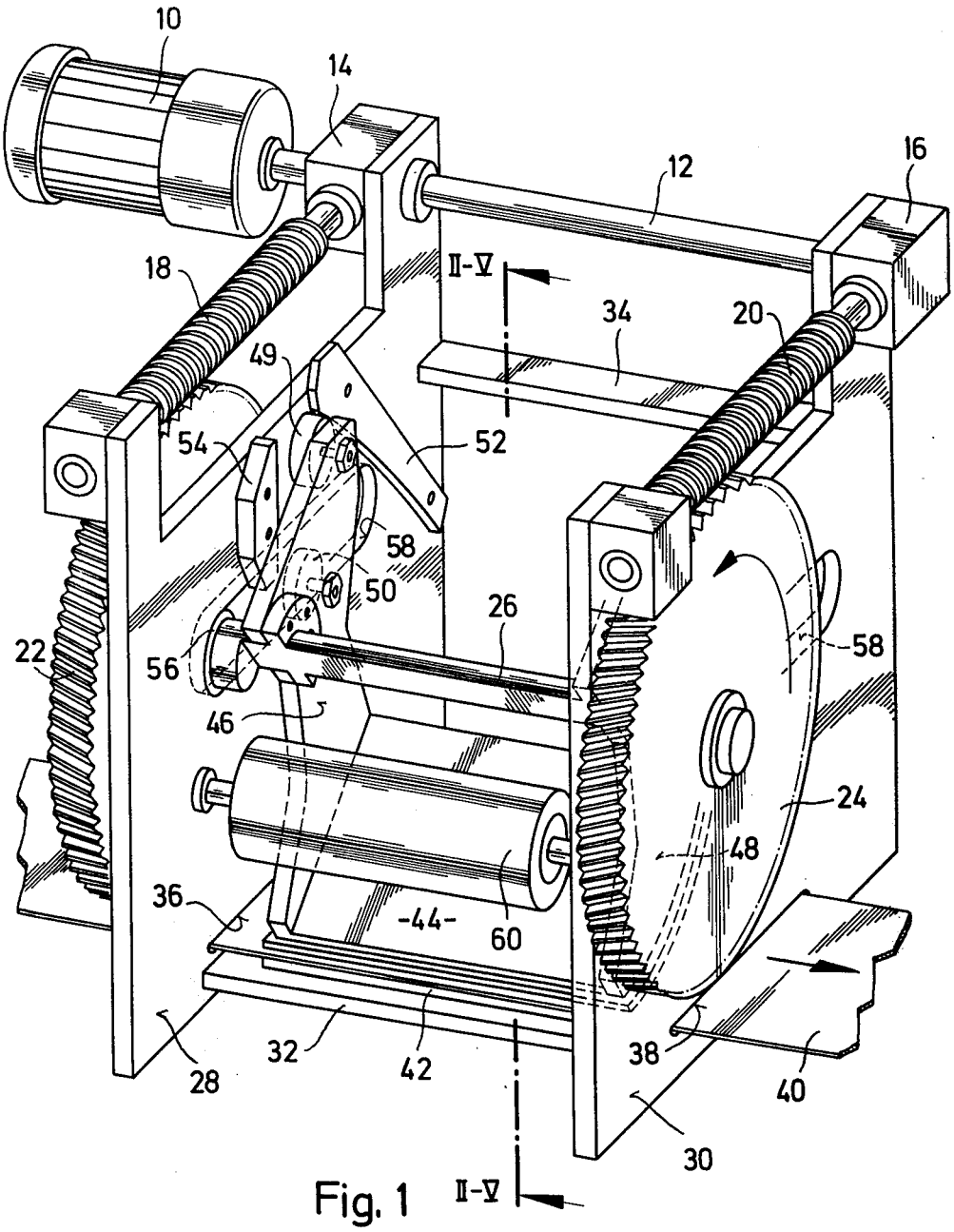
Figure 2:
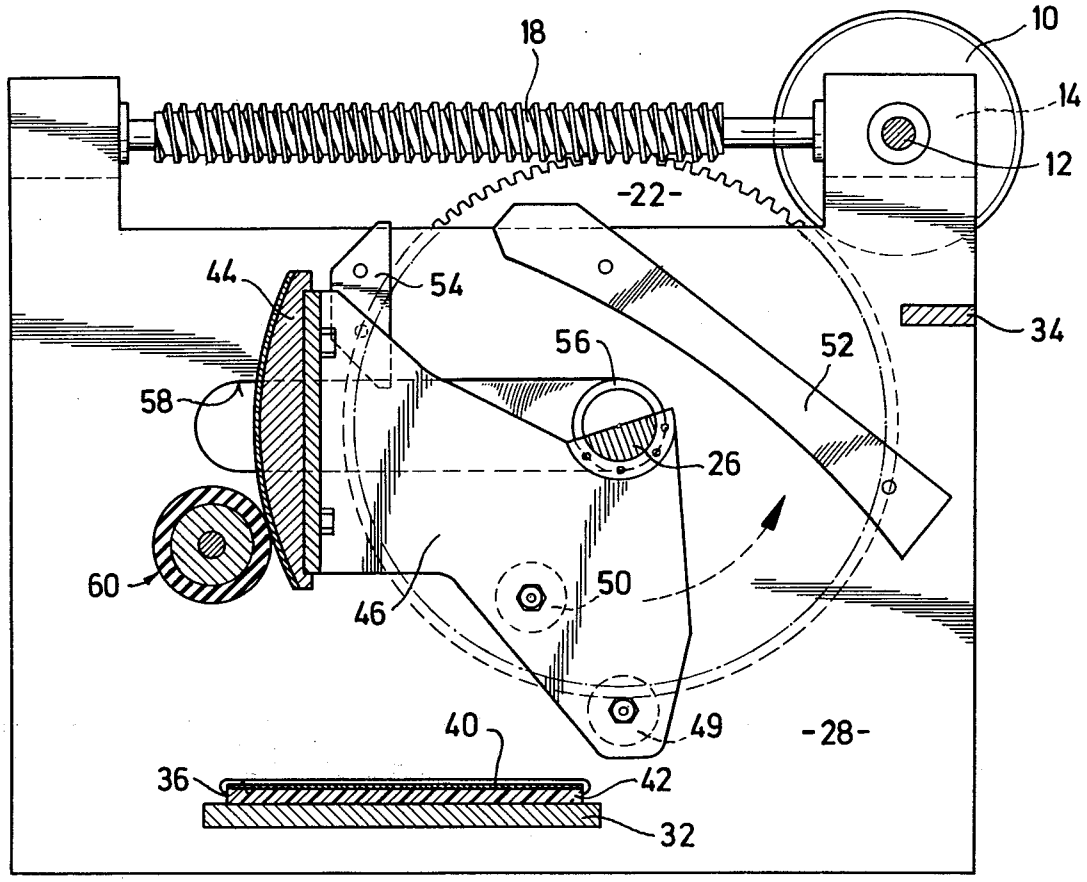

The invention relates to a printing machine for printing a discontinuously moved, flat web, for example, for printing labels. Printing machines of this kind are arranged, for example, in a production line for labels.

A printing machine of this type normally comprises a frame in which a printing block carrier is mounted; the printing block carrier may be a cylinder, or a partial cylinder member. The printing block carrier is then movably mounted in a frame and rolls onto the flat web during the printing process. To ink the printing block, which in most cases is a cliche which is fixed on the printing block carrier, the printing block carrier travels past an inking device in the course of its rotation.

Since the material to be printed on, i.e., the discontinuously moved web, remains stationary during the printing process, the printing block carrier must also execute a linear movement in addition to the rotary motion, and must return to its starting position from the final position of this linear movement.

In a known printing machine, the frame in which the printing block carrier is mounted effects this backward and forward movement.

Since the inking device is also mounted on the frame, this is also moved backward and forward. For this reason very considerable masses have to be moved. Due to the uniformity with which the printing process itself must be effected, the accelerations and decelerations occurring additionally at the end of the linear movement are particularly high. For these reasons the speeds of operation and/or the printing width (in the rolling direction) are restricted.

It is an object of the present invention to provide a printing machine for printing a discontinuously moved, flat web. In the printing machine, there is mounted in a frame a printing block carrier which carries on a cylindrical surface thereof the printing block which may be rolled onto the web. The printing block carrier is driven constantly to rotate in the same direction, the printing block coming into contact with an inking device during each rotation and subsequently effecting a printing process. The printing block carrier is additionally subjected to a linear backward and forward movement parallel to its axis of rotation and to the web so that the masses being moved are reduced to a minimum. To solve the problem, then according to the invention, the shaft of the printing block carrier is movably guided in the fixed frame between a first and a second extreme position of the linear movement during the printing process, and the inking device is arranged in its first extreme position during the rotary movement of the printing block carrier to make contact with the printing block. It is evident that, in this construction, the frame with the inking device is stationary and it is only the printing block carrier, together with its shaft and all the gear elements connected to it, which executes superimposed rotational and backward and forward movements. The moving masses are consequently very small; thus the acceleration and deceleration forces to be applied or absorbed are very small as well.

The printing block carrier is preferably driven in a manner such that on its shaft there are screwed or keyed one or two worm gears, which are constantly engaged with one constantly driven worm in each case. The gear elements already mentioned then act in the extreme positions as a rotating drive, whereas in the course of the linear movement the worm acts on the one hand as a toothed rack to guide the printing block carrier, and on the other hand continues to provide the rotational torque for the rotary movement. If there is one worm gear on each end of the shaft and the worms rotate in synchronism (which is obvious), an additional linear movement can be dispensed with. It is then sufficient, for example, to provide in the frame longitudinal slots parallel to the web of material to be printed, in which slots the step bearings for the shaft may be movably guided.

A control device is provided to control the temporal course of the superimposed movements, and if the type of shaft described in the previous paragraph is chosen, then the control process can be effected in a particularly simple manner. Disc-like stops may then be provided having associated cams which come into engagement in the corresponding angular positions of the printing block carrier and convert the rotary movement to the superimposed rotary and linear movement or vice versa.

The moving mass may be reduced further when the printing block carrier, preferably constructed as a hollow body, is constructed in the shape of a sector of a cylinder. The distortions which may be attributed to the buckling of a cliche which has been bonded on are then even smaller, the smaller the angle extent of the sector of the cylinder. This type of construction is also very space-saving because towards the end of the printing process, directly before the printing block carrier returns to its starting position, the section of the sector of the cylinder which effects the printing then lies averted from the space at the side of the frame so that the inking device may then be arranged there. This means that even an extensive inking device with a large number of rollers may be provided so that, if desired, printing may be effected by the offset method and even with more than one colour.

In principle, the printing block carrier may operate parallel to the discontinuous movement of the web or transversely to this. However, the latter embodiment is preferred because it is then easier to control the registration stability of the printing on the one hand, and on the other, the inking device with its drive mechanisms is situated not above, but laterally to, the web and is thus more easily accessible.

Figure 3:
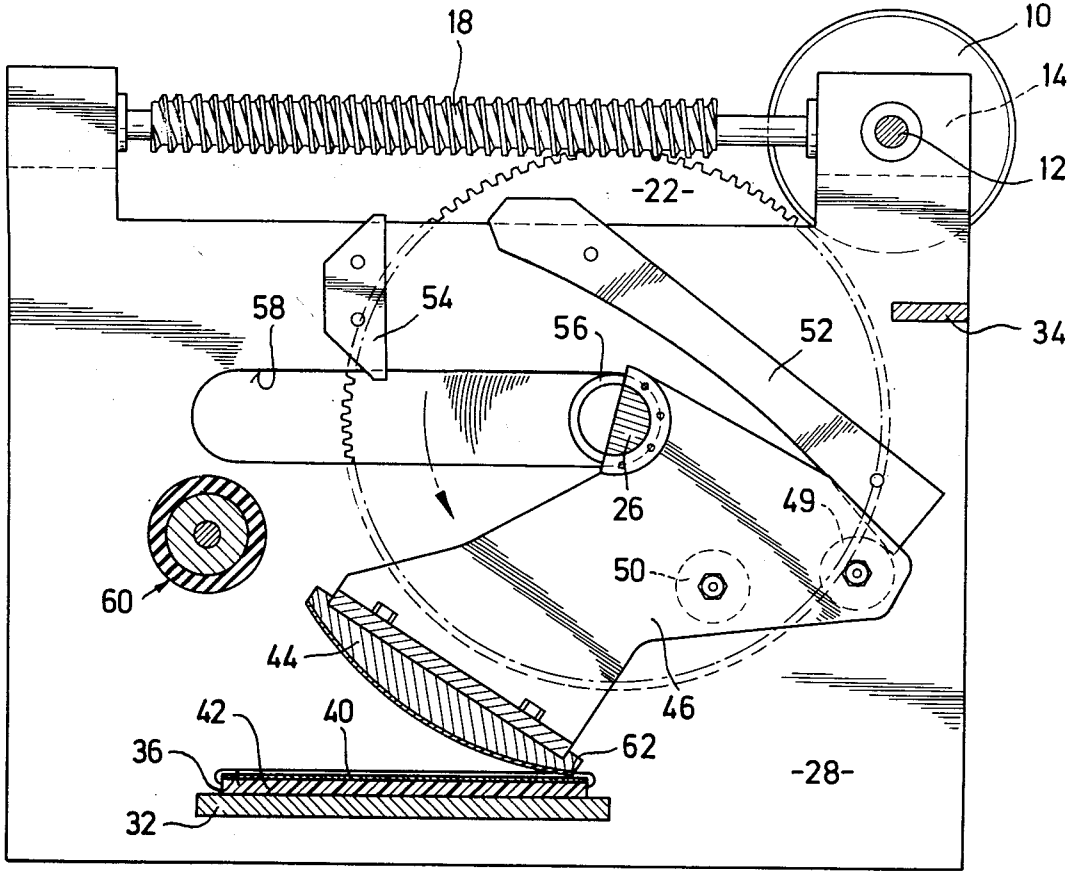
Figure 4:
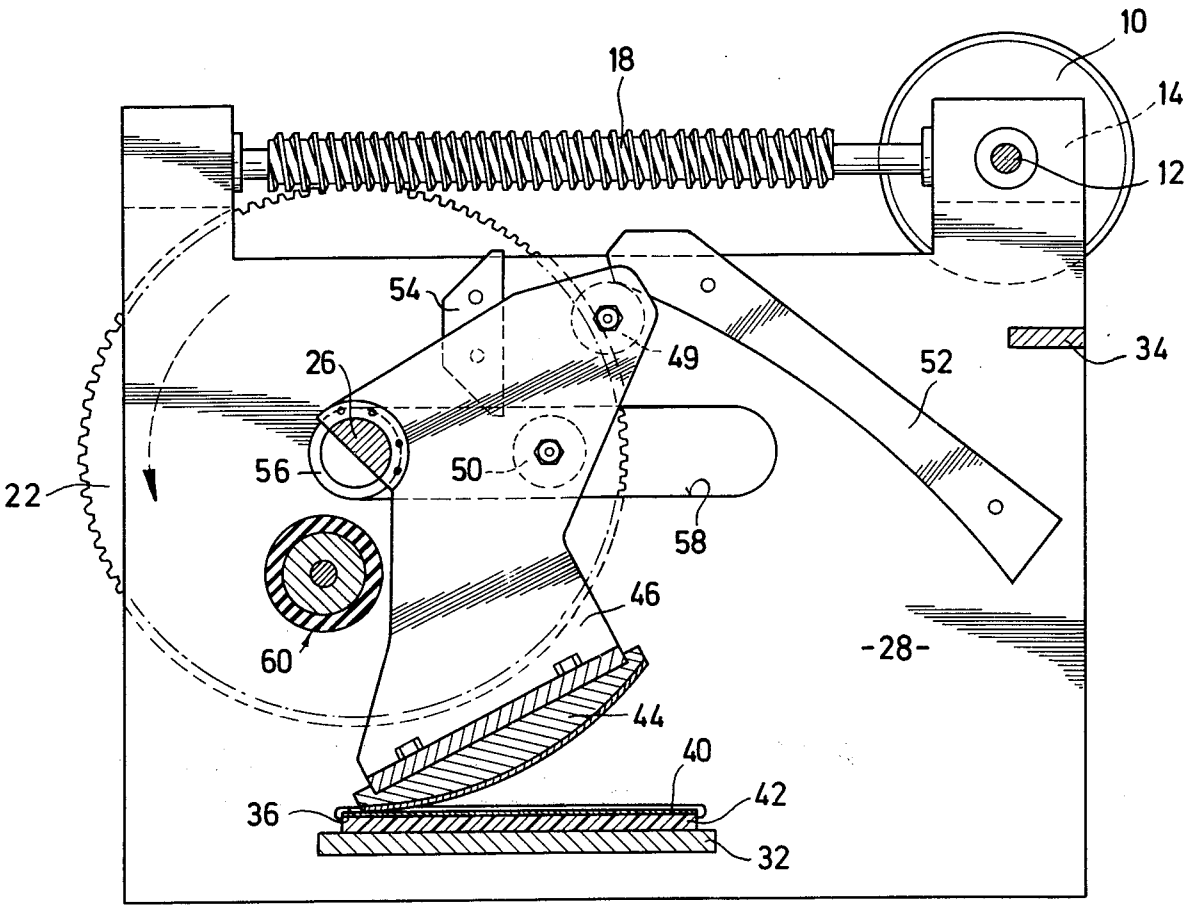

A printing machine constructed in accordance with the invention will now be described by way of example, with reference to the accompanying drawings, in which:

FIG. 1 shows a perspective view of the essential parts of the printing machine in schematic representation, and FIGS. 2 to 5 show a side, cross sectional view of the four successive phases of the printing process; in this, FIG. 4 corresponds to the position shown in FIG. 1.

FIG. 1 shows only those parts of the printing machine which are essential to the invention. A main shaft 12 is driven constantly in a rotary movement by a driven unit 10 which is known per se. Two worms 18, and 20 are driven synchronously in a rotary movement by mitre-wheel gears in gear boxes 14 and 16 respectively. Each worm is engaged with an associated worm gear 22 and 24, respectively. The two worm gears are connected together by a shaft 26. The entire arrangement is mounted in a frame comprising vertical plates 28 and 30, which are connected together by a base plate 32 and transverse struts, of which only one, identified by the reference numeral 34, is illustrated.

The vertical plates 28 and 30 have slits 36 and 38 respectively through which the web 40 to be printed enters from the left in the drawing and is guided between the plates above the base plate 32 through the frame and leaves again to the right. The web is guided discontinuously; the drive means are not shown as they do not form a part of the present invention. However, it should be noted that the drive 10 is synchronised with the drive for the web in so far as that after every forward movement of the web, whilst the web is stationary, a printing process occurs in a manner still to be described. Controllable couplings may be provided for this.

In the area of the web, there is arranged below the web and resting on the base plate 32, a counter-pressure plate 42 which in a manner known per se may carry a rubber or plastic overlay to influence the result of the printing.

The actual printing block carrier rests on the shaft 26. It comprises a sector of a cylinder jacket 44, which is secured between two side brackets 46 and 48 which in turn are screwed, for example, to the shaft 26. On the outer surface of the cylinder jacket section 44 facing the web there is fastened a cliche, which is not visible in FIG. 1. On the outer side of the bracket 46, two cam discs 49 and 50 are movably mounted whilst, on the inner side of the vertical plate 28, two control cam bars 52 and 54 which cooperate together are secured. The step-bearings of the shaft 26, of which only one bearing 56 can be seen, are disposed in longitudinal slots (here too, only one longitudinal slot 58 can be seen) and may be moved along these longitudinal slots.

Somewhat below the longitudinal slots and before them, there is arranged the inking device, of which only the last roller 60 is visible here. It is driven constantly in a rotary movement and, if desired such as during offset printing, synchronized with the rotation of the printing block carrier. Several inking rollers may come into contact successively with the printing block. The remaining parts of the inking device are not illustrated for the sake of clarity. The inking device does not have to be constructed in any manner different from the conventional construction for the purposes of the present invention.

The mode of operation of the printing machine described so far is given in more detail below with reference to FIGS. 2 to 5.

The Figures show cross sectional views in the direction of the arrow II-V in FIG. 1 and are restricted to the more important elements.

At the start of the printing process, the shaft 26 and its bearings 56 are situated at the inner right-hand end (according to the drawings) of the longitudinal slots 58. The worm 18 drives the worm gear 22 and thus also the shaft 26 and causes them to rotate in the direction of the arrow. At first, only this rotary movement takes place since the friction of the shaft 26 in its bearing 56 is less than the friction of the latter in the longitudinal slot 58. If desired, by using a weak spring or similarly known means it may be ensured that the shaft 26 favors the position shown in FIG. 2 at the back end of the longitudinal slots 58.

In this phase, the cam rollers 49 and 50 rotate freely, without coming into contact with the control cam bars 52 and 54, respectively. The cliche, which is fastened to the printing block carrier or to its cylinder jacket sector 44 travels past the inking roller 60 and takes up ink as a result.

In FIG. 3, the edge 62 of the printing block reaches the web 40 and simultaneously the roller 49 runs up to the control cam bar 52. The printing block carrier can then no longer rotate freely and the rolling off process begins i.e. the actual printing process with linear movement of the shaft 26 and all parts connected firmly to it towards the left, i.e., towards the outside. Guidance is effected in this movement by the longitudinal slots 58.

The end of the printing process (FIG. 4) is reached when the shaft 26 has reached the outer (left) end of the longitudinal slots 58. In this position the roller 49 also reaches the end of the control cam bar 52, and the cam roller 50 is directly below the cam surface running vertically upwards on the other cam control bar 54. As the printing block carrier rotates further, the roller 50 comes up against the bar 54, and thus prevents further rotation in the outer (left-hand) extreme position and forces the shaft 26 to travel back along the longitudinal slot 58. In this, the roller 49 pivots between the bars 52 and 54 and passes along the line 64 (FIG. 5) back into the position shown in FIG. 2 and around in front of the bar 54. From the extreme position of FIG. 5 the roller 50 travels downwardly along the cam control bar 54 again until it also reaches the position shown in FIG. 2.

Figure 5:
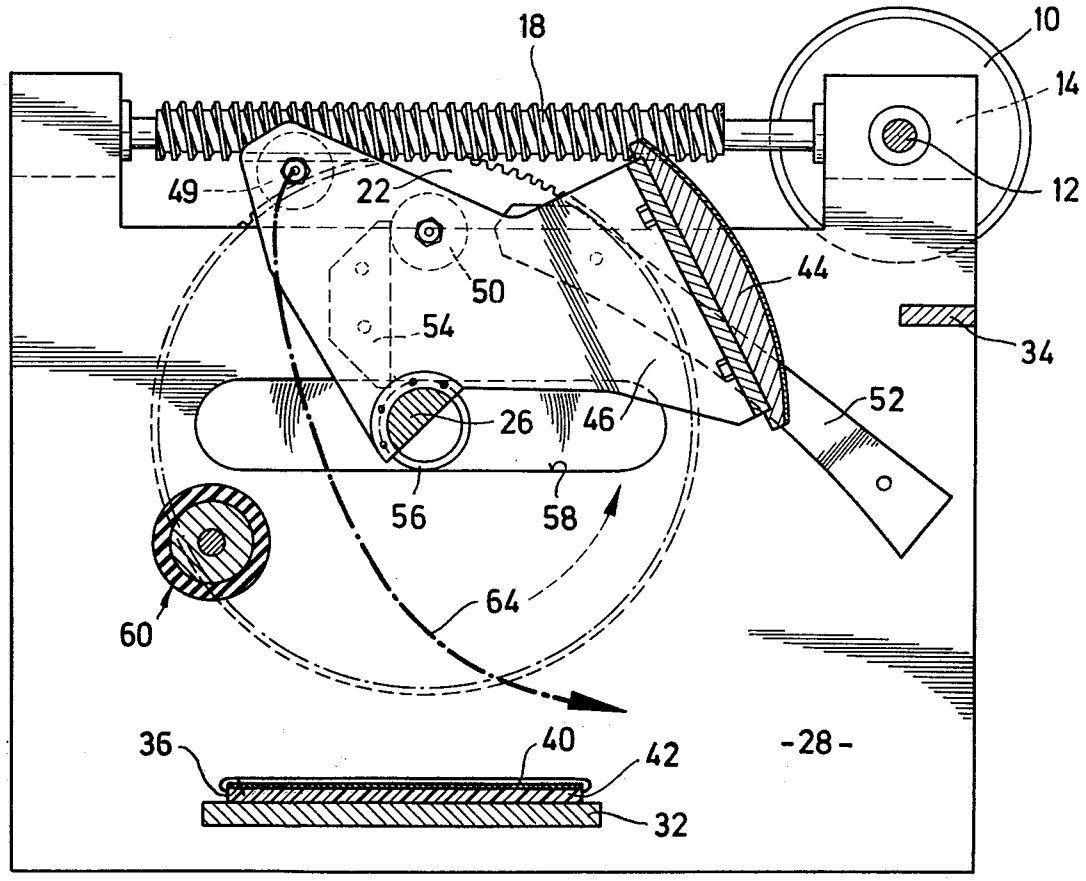

FIGS. 4 and 5 illustrates how the printing block carrier is able to travel past the inking roller 60 without any projecting part being forced to move the inking device with respect to the frame. It is also evident that the cam surface on the bar 54 may be designed in a manner such that the printing block carrier is returned again to the inner extreme position more quickly, wherein the inking device or a second inking device could be arranged diagonally above the position of the inking roller 60 shown here.

Instead of using the cams, it is further possible to act directly on the bearing 56 with a drive, possible a second worm, which drive would then operate discontinuously and in synchronism with the rotary movement.

I claim:

1. A printing machine for printing on a discontinuously moved, flat web comprising a frame;

a counter pressure plate mounted on said frame over which said discontinuously moved flat web passes;

means in said frame forming guide tracks which extends parallel to the counter pressure plate;

a printing block carrier having a curved jacket upon which a printing block is mounted, said carrier being journalled to rotatable bearings which are slidably positioned in said guide tracks;

drive means connected to said printing block carrier to cause rotation of the carrier about the axis defined by said bearings and to move said bearings in said guide tracks so that said printing block rolls over said web lying on said counter pressure plate; and inking means stationarily mounted on said frame;

wherein, in use, the printing block carrier rotates in the same direction about an axis defined between said rotatable bearings, the printing block coming into contact with the inking means during each rotation before contact with the web, and the printing block carrier executing linear backward and forward movement such that its axis of rotation moves perpendicular to itself and parallel to the web, and wherein the frame is fixed and the carrier so guided in the frame as to execute the linear movement relative thereto, and the inking device is arranged to contact the printing block as the carrier executes rotary movement at one extreme of its linear movement.

2. A printing machine as claimed in claim 1, wherein said printing block carrier is connected to a rotatable shaft;

wherein said bearings are connected to the ends of said shaft;

and wherein at least one of said bearings is connected to a worm gear which is driven in constant rotation.

3. A printing machine as claimed in claim 2, wherein means are mounted on said frame to provide synchronism of the rotary and linear movements of said printing block carrier.

4. A printing machine as claimed in claim 3, wherein said synchronism-providing means comprises control cam bars, and wherein cam discs are mounted on said printing block carrier to suitably cooperate with said control cam bars mounted on said frame.

5. A printing machine as claimed in claim 4, wherein said printing block is shaped in the form of a sector of a cylinder.

6. A printing machine as claimed in claim 5, wherein the printing block carrier is hollow.

7. A printing machine as claimed in claim 5, wherein said frame comprises two vertically extending plates, an interconnecting horizontal base plate and at least one horizontal interconnecting strut; and wherein said guide tracks are located in said vertically extending plates.

8. A printing machine as claimed in claim 7, wherein said counter pressure plate is attached to said interconnecting horizontal base plate, and wherein means in each of said vertical extending plates allows for said web to pass therethrough and in contact with said counter pressure plate.

9. A printing machine as claimed in claim 8, wherein said inking means comprises at least one inking roller rotatably mounted between said vertical extending plates.

10. A printing machine as claimed in claim 9, wherein said worm gear is driven by a constantly rotating worm.

11. A printing machine as claimed in claim 10, wherein two worm gears are employed, one connected to each of said bearings on the ends of said shaft, and wherein two worms are provided to respectively drive each of said worm gears in synchronism.

12. A printing machine for printing on a discontinuously moved, flat web comprising a frame composed of two separated vertical plates interconnected by a horizontal base plate and at least one horizontal strut;

said vertical plates each having therein openings forming horizontal guide tracks;

a rotatable shaft having bearing means at each end thereof mounted in said guide tracks and between said vertical plates;

a printing block carrier connected to said rotatable shaft, said printing block carrier having attached thereto a curved printing block as well as cam discs;

roller inking means fixedly mounted between said vertical plates;

a counter pressure plate positioned on said base plate adapted for paper web movement thereover;

means for constantly rotating said shaft and said printing block carrier in the same direction; and control cam bar means mounted on at least one of said vertical plates for cooperation with said cam discs attached to said printing block carrier, such that upon rotation of said shaft and said printing block carrier said curved printing block contacts said roller inking means, then uniformly prints upon a web passing over said counter pressure plate in a linear back and forth movement and then is guided away from said web and counter pressure plate and continues in vertical rotation to again contact said roller inking means, said bearings and thus said printing block carrier appropriately moving in said horizontal guide tracks.

* * * * *